US009913337B2

(12) United States Patent
Kim et al.

(10) Patent No.: US 9,913,337 B2
(45) Date of Patent: Mar. 6, 2018

(54) CONTROL CIRCUIT OF LIGHT EMITTING DIODE LIGHTING APPARATUS

(71) Applicant: SILICON WORKS CO., LTD., Daejeon (KR)

(72) Inventors: Yong Goo Kim, Daejeon-si (KR); Kyung Min Kim, Daejeon-si (KR); Jong Min Lee, Busan (KR); Young Suk Son, Daejeon (KR); Won Ji Lee, Cheonahn-si (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 14/917,383

(22) PCT Filed: Apr. 3, 2014

(86) PCT No.: PCT/KR2014/002881

§ 371 (c)(1),
(2) Date: Mar. 8, 2016

(87) PCT Pub. No.: WO2015/041393

PCT Pub. Date: Mar. 26, 2015

(65) Prior Publication Data

US 2016/0219667 A1 Jul. 28, 2016

(30) Foreign Application Priority Data

Sep. 17, 2013 (KR) ..... 10-2013-0112123

(51) Int. Cl.
*H05B 33/08* (2006.01)

(52) U.S. Cl.
CPC ..... *H05B 33/0848* (2013.01); *H05B 33/0824* (2013.01)

(58) Field of Classification Search
CPC ..... H05B 33/0824; H05B 33/0848
See application file for complete search history.

(56) References Cited

U.S. PATENT DOCUMENTS

2010/0308738 A1* 12/2010 Shteynberg ..... H05B 33/0812 315/185 R
2011/0273102 A1* 11/2011 van de Ven ..... H05B 33/0809 315/193

(Continued)

FOREIGN PATENT DOCUMENTS

CN 1816233 8/2006
JP 8-294273 11/1996

(Continued)

OTHER PUBLICATIONS

International Search Report with English translation for International Application No. PCT/KR2014/002881 dated, Jun. 20, 2014.

(Continued)

*Primary Examiner* — Douglas W Owens
*Assistant Examiner* — Pedro C Fernandez
(74) *Attorney, Agent, or Firm* — Kile Park Reed & Houtteman PLLC

(57) ABSTRACT

Disclosed is a control circuit of an LED lighting apparatus, which compensates for power for light emission of a lamp including LEDs. The control circuit can generate a compensation signal corresponding to change of power provided to the lamp, and uniformly maintain the power by controlling a current provided to the lamp in response to the compensation signal. Thus, the control circuit can compensate for the power change of the lamp due to a power supply environment factor in a building, region, or country or a temporarily unstable power supply environment factor, such that the lamp can emit light at uniform luminance.

17 Claims, 7 Drawing Sheets

(56) References Cited

U.S. PATENT DOCUMENTS

| | | | | |
|---|---|---|---|---|
| 2015/0042234 | A1* | 2/2015 | Lee | H05B 33/0824 315/193 |
| 2015/0296582 | A1* | 10/2015 | Jung | H05B 33/0812 315/185 R |

FOREIGN PATENT DOCUMENTS

| | | |
|---|---|---|
| JP | 2011-198561 | 10/2011 |
| JP | 5296937 | 6/2013 |
| KR | 10-2011-0090201 | 8/2011 |
| KR | 10-1175934 | 8/2012 |
| KR | 10-2012-0104788 | 9/2012 |
| KR | 10-1208347 | 12/2012 |
| KR | 10-2013-0069516 | 6/2013 |
| KR | 10-1299360 | 8/2013 |
| KR | 10-2013-0110410 | 10/2013 |
| KR | 10-1521644 | 5/2015 |

OTHER PUBLICATIONS

Written Opinion with English translation for International Application No. PCT/KR2014/002881 dated, Jun. 20, 2014.

International Preliminary Report on Patentability with English translation for International Application No. PCT/KR2014/002881 dated, Jan. 5, 2016.

* cited by examiner

CONTROL CIRCUIT OF LIGHT EMITTING DIODE LIGHTING APPARATUS

TECHNICAL FIELD

The present disclosure relates to an LED lighting apparatus, and more particularly, to a control circuit of an LED lighting apparatus, which compensates for power for light emission of a lamp including LEDs.

BACKGROUND ART

According to the recent trend of lighting technology, an LED has been employed as a light source, in order to reduce energy.

A high-brightness LED is differentiated from other light sources in terms of various aspects such as energy consumption, lifetime, and light quality.

However, a lighting apparatus using the LED as a light source requires a large number of additional circuits, because the LED is driven by a constant current.

In order to solve the above-described problem, an AC direct-type lighting apparatus has been developed.

The AC direct-type LED lighting apparatus generates a rectified voltage from a commercial AC power supply, and drives an LED. Since the AC direct-type LED lighting apparatus directly uses the rectified voltage as an input voltage without using an inductor and capacitor, the AC direct-type LED lighting apparatus has a satisfactory power factor.

In general, an LED lamp of the LED lighting apparatus includes a large number of LEDs which are coupled in series.

The LED lighting apparatus may be used in various power supply environments. The environment for supplying power may differ in each building or house, and differ in each region or country. Furthermore, the LED lighting apparatus may be placed in a temporarily unstable power supply environment in addition to the above-described environment.

In the above-described power supply environment, the LED lighting apparatus may receive a rectified voltage having a lower level than the rectified voltage which is designed to drive the lamp. In this case, the LED lighting apparatus may not emit light at a designed luminance.

Furthermore, when the LED lighting apparatus is operated in an unstable power supply environment, the LED lighting apparatus may not maintain uniform luminance due to a temporary drop of the rectified voltage.

Thus, the conventional LED lighting apparatus may not maintain uniform luminance due to the above-described environmental factors.

DISCLOSURE

Technical Problem

Various embodiments are directed to a control circuit of an LED lighting apparatus, which is capable of securing uniform luminance by compensating for power supplied to a lamp in response to a power supply environment factor in a building, region, or country or a temporarily unstable power supply environment factor.

Technical Solution

In an embodiment, there is provided a control circuit of an LED lighting apparatus which includes a plurality of LED groups to emit light according to a rectified voltage. The control circuit may include: a rectified voltage sensing unit configured to sense the rectified voltage and provide a sensing signal; and a control unit configured to compare reference voltages to a current sensing voltage corresponding to a current amount based on light emission of the LED groups, the reference voltages being allocated to the respective LED groups and having a level controlled in response to the sensing signal, and provide a current path corresponding to the light emitting states of the LED groups. The current amount on the current path may be controlled in response to the sensing signal.

In another embodiment, there is provided a control circuit of an LED lighting apparatus which comprises a plurality of LED groups to emit light according to a rectified voltage. The control circuit may include: a rectified voltage sensing unit configured to provide a sensing signal obtained by sensing the rectified voltage; a rectified voltage compensation circuit configured to generate a compensation signal corresponding to change of the power provided to the plurality of LED groups in response to the sensing signal; a reference voltage control unit configured to reflect the compensation signal and provide reference voltages allocated to the respective LED groups; and a plurality of switching circuits provided for the respective LED groups, and configured to compare the reference voltages to a current sensing voltage corresponding to a current amount based on light emission of the LED groups, and provide a current path corresponding to the light emitting states of the LED groups. The reference voltages may be controlled in response to change of the power provided to the plurality of LED groups, such that the current amount on the current path is controlled.

Advantageous Effects

According to the embodiments of the present invention, the control circuit of the LED lighting apparatus can compensate for a power supply environment factor in a building, region, or country or a temporarily unstable power supply environment factor through current adjustment. Thus, the control circuit can compensate for power for light emission of a lamp using LEDs.

Furthermore, as the control circuit compensates for the power for the emission of the lamp which drives the LEDs to emit light, the LED lighting apparatus can emit light at uniform luminance in various power supply environments, which makes it possible to maximize the reliability of products.

MODE FOR INVENTION

Figure 1:
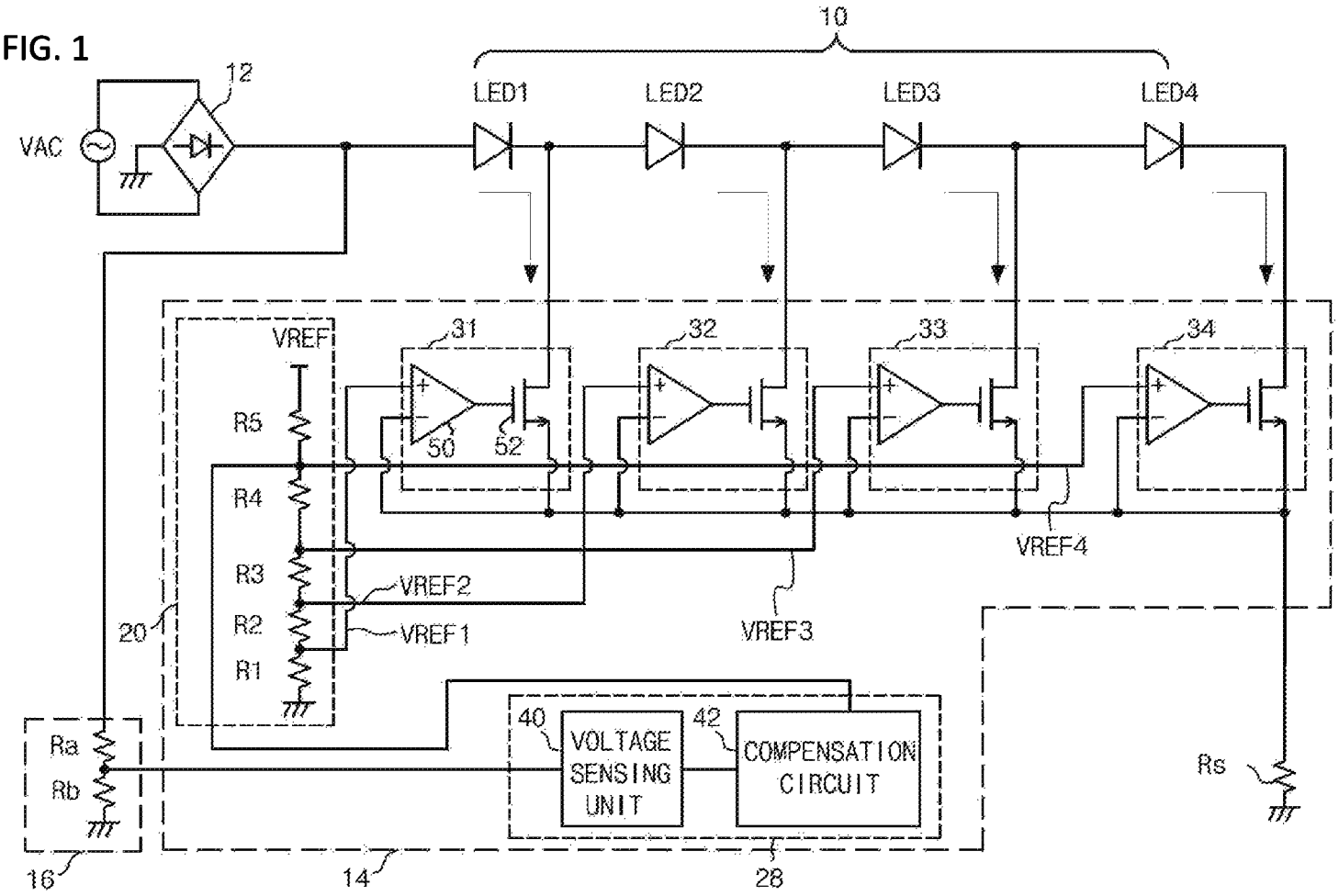
FIG. 1 is a circuit diagram illustrating a control circuit of an LED lighting apparatus according to an embodiment of the present invention.

Hereafter, exemplary embodiments of the present invention will be described in detail with reference to the accompanying drawings. The terms used in the present specification and claims are not limited to typical dictionary definitions, but must be interpreted into meanings and concepts which coincide with the technical idea of the present invention.

The Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

The present invention discloses embodiments which are configured to compensate for a power change caused by a rectified voltage variation, using a current.

A control circuit of an LED lighting apparatus according to an embodiment of FIG. 1 is configured to perform a current regulation function for light emission of a lamp 10 and a function of compensating for change corresponding to a rectified voltage variation caused by a power supply environment factor of power provided to the lamp 10.

Referring to FIG. 1, the LED lighting apparatus according to the embodiment of the present invention may include a lamp 10, a power supply unit, and a control unit 14. The power supply unit provides a rectified voltage obtained by converting commercial power to the lamp 10, and the control unit 14 provides a current path for light emission of the lamp 10.

Figure 2:
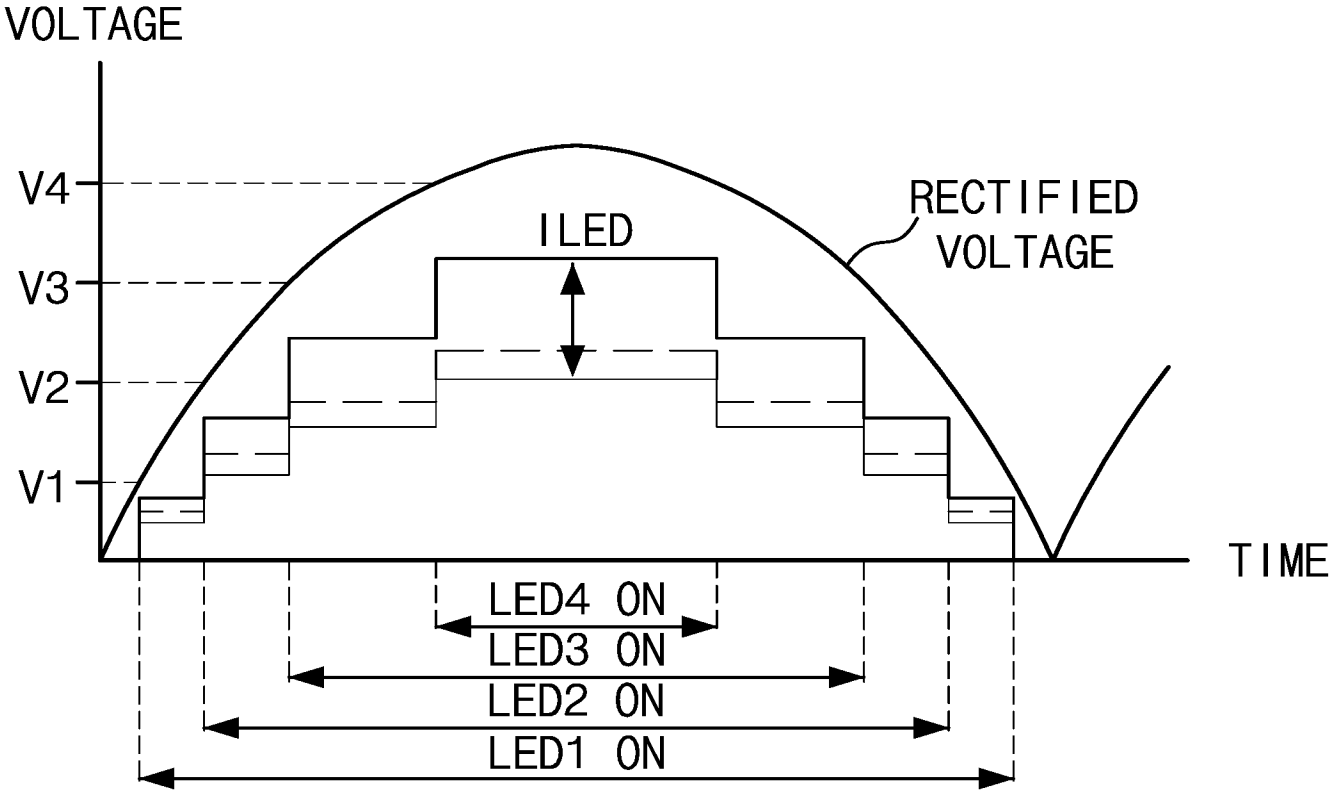
FIG. 2 is a waveform diagram for describing the operation of the control circuit according to the embodiment of FIG. 1.

The lamp 10 includes LEDs coupled in series and divided into a plurality of groups. The respective groups of the lamp sequentially emit light according to a ripple of the rectified voltage provided from the power supply unit as illustrated in FIG. 2.

FIG. 1 illustrates that the lamp 10 includes four LED groups LED1 to LED4 coupled in series, and the number of LED groups may be changed according to a designer's intention. Each of the LED diode groups LED1 to LED4 may include a plurality of LEDs coupled in series, parallel, or serial-parallel to each other. For convenience of description, the plurality of LEDs are represented by one diode symbol.

The power supply unit is configured to rectify an external AC voltage and output the rectified voltage.

The power supply unit may include an AC power supply VAC having an AC voltage and a rectifier circuit 12 for outputting a rectified voltage by rectifying the AC voltage. The AC power supply VAC may include a commercial power supply.

The rectifier circuit 12 full-wave rectifies a sine-wave AC voltage of the AC power supply VAC, and outputs the rectified voltage. Thus, as illustrated in FIG. 2, the rectified voltage has a ripple in which the voltage level thereof level rises/falls on a basis of the half cycle of the AC voltage.

The control unit 14 performs current regulation for light emissions of the respective LED groups LED1 to LED4. The control unit 14 may be implemented as one chip, and configured to provide a current path through an external current sensing unit including a current sensing resistor Rs of which one end is grounded.

According to the above-described configuration, the LED groups LED1 to LED4 of the lamp 10 are sequentially turned on or off in response to the rises or falls of the rectified voltage. When the rectified voltage rises to sequentially reach light emission voltages V1 to V4, the control unit 14 selectively provides a current path for light emission of the LED groups LED1 to LED4.

The light emission voltage V4 of the LED group LED4 is defined as a voltage for controlling all of the LED groups LED1 to LED4 to emit light, the light emission voltage V3 of the LED group LED3 is defined as a voltage for controlling the LED groups LED1 to LED3 to emit light, the light emission voltage V2 of the LED group LED2 is defined as a voltage for controlling the LED groups LED1 and LED2 to emit light, and the light emission voltage V1 of the LED group LED1 is defined as a voltage for controlling only the LED group LED1 to emit light.

The control unit 14 may use a current sensing voltage sensed through the current sensing resistor Rs, and the current sensing voltage may be varied by the current amount of the current path which is changed according to the light emitting states of the respective LED groups of the lamp 10. At this time, the current flowing through the current sensing resistor Rs may include a constant current.

The control unit 14 includes a plurality of switching circuits 31 to 34 and a reference voltage control unit 20. The plurality of switching circuits 31 to 34 provide a current path for the LED groups LED1 to LED4, and the reference voltage control unit 20 provides reference voltages VREF1 to VREF4.

The reference voltage control unit 20 includes a plurality of resistors R1 to R5 which are coupled in series to receive a constant voltage VREF. The reference voltage control unit 20 may include a plurality of voltage sources for providing the reference voltages VREF1 to VREF4.

In the reference voltage control unit 20, the resistor R1 is coupled to the ground, and the resistor R5 receives the constant voltage VREF. The resistor R5 serves as a load resistor for adjusting an output. The resistors R1 to R4 serve to output the reference voltages VREF1 to VREF4 having different levels. Among the reference voltages VREF1 to VREF4, the reference voltage VREF1 may have the lowest voltage level, and the reference voltage VREF4 may have the highest voltage level.

The resistors R1 to R4 may be configured to output four reference voltages VREF1 to VREF4 of which the levels gradually rise in response to variations of the rectified voltage applied to the LED groups LED1 to LED4.

The reference voltage VREF1 has a level for turning off the switching circuit 31 at the point of time that the LED group LED2 emits light. More specifically, the reference voltage VREF1 may be set to a level equal to or lower than the current sensing voltage which is formed in the current sensing resistor Rs by the light emission of the LED group LED2.

The reference voltage VREF2 has a level for turning off the switching circuit 32 at the point of time that the LED group LED3 emits light. More specifically, the reference voltage VREF2 may be set to a level equal to or lower than the current sensing voltage which is formed in the current sensing resistor Rs by the light emission of the LED group LED3.

The reference voltage VREF3 has a level for turning off the switching circuit 33 at the point of time that the LED group LED4 emits light. More specifically, the reference voltage VREF3 may be set to a level equal to or lower than the current sensing voltage which is formed in the current sensing resistor Rs by the light emission of the LED group LED4.

The reference voltage VREF4 may be set to a higher level than the current sensing voltage which is formed in the current sensing resistor Rs by the upper limit level of the rectified voltage.

The switching circuits 31 to 34 are commonly coupled to the current sensing resistor Rs for providing the current sensing voltage.

The switching circuits 31 to 34 compare the current sensing voltage of the current sensing resistor Rs to the reference voltages VREF1 to VREF4 of the reference voltage control unit 20, and are turned on/off to provide a selective current path for controlling the lamp 10 to emit light.

Each of the switching circuits 31 to 34 receives a high-level reference voltage as the switching circuit is coupled to an LED group remote from the position to which the rectified voltage is applied.

Each of the switching circuits 31 to 34 may include a comparator 50 and a switching element, and the switching element may include an NMOS transistor 52.

The comparator 50 included in each of the switching circuits 31 to 34 has a positive input terminal (+) configured to receive a reference voltage, a negative input terminal (−) configured to receive a current sensing voltage, and an output terminal configured to output a result obtained by comparing the reference voltage and the current sensing voltage. The NMOS transistor 52 included in each of the switching circuits 31 to 34 is turned on or off to selectively provide a current path, according to the output of the comparator 50, which is applied to the gate thereof.

According to the above-described configuration, the control circuit according to the embodiment of FIG. 1 performs an operation for light emission of the lamp. This operation will be described with reference to FIG. 2.

When the rectified voltage is in the initial state, the LED groups are turned off. Thus, the current sensing resistor Rs provides a low-level current sensing voltage.

More specifically, when the rectified voltage is in the initial state, all of the switching circuits 31 to 34 maintain the turn-on state, because the reference voltages VREF1 to VREF4 applied to the positive input terminals (+) of the respective switching circuits 31 to 34 are higher than the current sensing voltage applied to the negative input terminals (−).

Then, when the rectified voltage rises to reach the light emission voltage V1, the LED group LED1 of the lamp 10 emits light. When the LED group LED1 of the lamp 10 emits light, the switching circuit 31 of the control unit 14, coupled to the LED group LED1, provides a current path.

When the rectified voltage reaches the light emission voltage V1 such that the LED group LED1 emits light, the current path is formed through the switching circuit 31, and the level of the current sensing voltage of the current sensing resistor Rs rises. However, since the current sensing voltage at this moment has a low level, the turn-on states of the switching circuits 31 to 34 are not changed.

Then, when the rectified voltage continuously rises to reach the light emission voltage V2, the LED group LED2 of the lamp 10 emits light. When the LED group LED2 of the lamp 10 emits light, the switching circuit 32 of the control unit 14, coupled to the LED group LED2, provides a current path. At this time, the LED group LED1 also maintains the light emitting state.

When the rectified voltage reaches the light emission voltage V2 to turn on the LED group LED2, the current path is formed through the switching circuit 32, and the level of the current sensing voltage of the current sensing resistor Rs rises. At this time, the current sensing voltage has a higher level than the reference voltage VREF1. Therefore, the NMOS transistor 52 of the switching circuit 31 is turned off by the output of the comparator 50. That is, the switching circuit 31 is turned off, and the switching circuit 32 provides a current path corresponding to the light emission of the LED group LED2.

Then, when the rectified voltage continuously rises to reach the light emission voltage V3, the LED group LED3 of the lamp 10 emits light. When the LED group LED3 of the lamp 10 emits light, the switching circuit 33 of the control unit 14, coupled to the LED group LED3, provides a current path. At this time, the LED groups LED1 and LED2 also maintain the light emitting state.

When the rectified voltage reaches the light emission voltage V3 such that the LED group LED3 emits light, the current path is formed through the switching circuit 33, and the level of the current sensing voltage of the current sensing resistor Rs rises. At this time, the current sensing voltage has a higher level than the reference voltage VREF2. Therefore, the NMOS transistor 52 of the switching circuit 32 is turned off by the output of the comparator 50. That is, the switching circuit 32 is turned off, and the switching circuit 33 provides a current path corresponding to the turn-on of the LED group LED3.

Then, when the rectified voltage continuously rises to reach the light emission voltage V4, the LED group LED4 of the lamp 10 emits light. When the LED group LED4 of the lamp 10 emits light, the switching circuit 34 of the control unit 14, coupled to the LED group LED4, provides a current path. At this time, the LED groups LED1 to LED3 also maintain the light emitting state.

When the rectified voltage reaches the light emission voltage V4 such that the LED group LED4 emits light, the current path is formed through the switching circuit 34, and the level of the current sensing voltage of the current sensing resistor Rs rises. At this time, the current sensing voltage has a higher level than the reference voltage VREF3. Therefore, the NMOS transistor 52 of the switching circuit 33 is turned off by the output of the comparator 50. That is, the switching circuit 33 is turned off, and the switching circuit provides a selective current path corresponding to the light emission of the LED group LED2.

Then, although the rectified voltage continuously rises, the switching circuit 34 maintains the turn-on state, because the reference voltage VREF4 provided to the switching circuit 34 has a higher level than the current sensing voltage which is formed in the current sensing resistor Rs by the upper limit level of the rectified voltage.

The rectified voltage starts to fall after the upper limit level.

When the rectified voltage falls below the light emission voltage V4, the LED group LED4 of the lamp 10 is turned off.

When the LED group LED4 of the lamp 10 is turned off, the LED groups LED3, LED2, and LED1 maintain the light emitting state, and the control unit 14 provides a current path through the switching circuit 33 in response to the light emitting state of the LED group LED3.

Then, when the rectified voltage sequentially falls below the light emission voltages V3, V2, and V1, the LED groups LED3, LED2, and LED1 of the lamp 10 are sequentially turned off.

When the LED groups LED3, LED2, and LED1 of the lamp 10 are sequentially turned off, the control unit 14 sequentially provides a current path to the switching circuits 33, 32, and 31, while shifting the current path.

As described above, the LED groups LED1 to LED4 of the lamp 10 may be sequentially turned on and off according to the rectified voltage, and the control unit 14 may selectively provide a current path for light emission through current regulation.

Due to a power supply environment factor in a building, region, or country or a temporarily unstable power supply environment factor, non-uniform power may be provided to the lamp 10. That is, when the AC power supply VAC is destabilized, a turn-on current ILED provided to the lamp 10 as illustrated in FIG. 2 may be varied to destabilize the power provided to the lamp 10.

The LED lighting apparatus according to the embodiment of FIG. 1 may include a rectified voltage compensation circuit 28 and a rectified voltage sensing unit 16 for providing a sensing signal obtained by sensing the rectified voltage, in order to secure uniform luminance by compensating for the non-uniformity of power provided to the lamp 10 due to the unstable AC power source VAC.

Figure 3A:
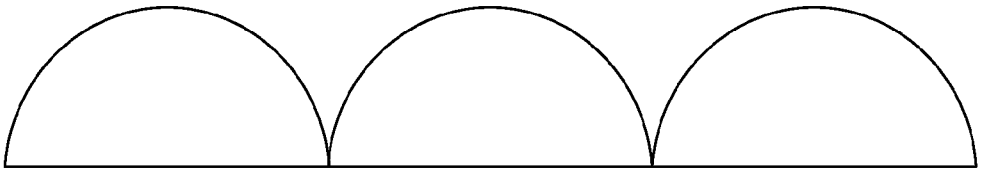
FIGS. 3A, 3B and 3C are waveform diagrams for describing a rectified voltage, a sensing signal, and a peak sensing signal.

The rectified voltage sensing unit 16 may be configured to output a sensing signal obtained by dividing the rectified voltage through resistors Ra and Rb coupled in series. The rectified voltage sensing unit 16 configured in the above-described manner may receive a rectified voltage having the same frequency and the same waveform as the rectified voltage supplied to the lamp 10, as illustrated in FIG. 3A.

Figure 3B:
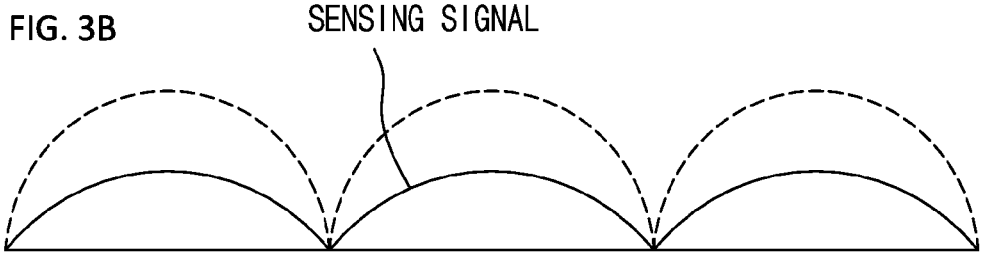

The rectified voltage sensing unit 16 generates and outputs a sensing signal obtained by scaling down the rectified voltage according to the resistance ratio of the resistors Ra and Rb, as illustrated in FIG. 3B.

The control unit 14 includes the rectified voltage compensation circuit 28 for varying the reference voltages VREF1 and VREF4 outputted from the reference voltage control unit 20 using the sensing signal of the rectified voltage sensing unit 16, and the rectified voltage compensation circuit 28 includes a voltage sensing unit 40 and a compensation circuit 42. The rectified voltage compensation circuit 28 may be included in the control unit 14 or provided separately from the control unit 14.

The rectified voltage compensation circuit 28 generates a compensation signal for varying the reference voltages VREF1 to VREF4 outputted from the reference voltage control unit 20 using the sensing signal of the rectified voltage sensing unit 16. The compensation signal is provided to the reference voltage control unit 20, and the reference voltage control unit 20 changes the levels of the reference voltages VREF1 to VREF4 according to the compensation signal. As a result, the amount of current flowing through the current path may be controlled to supply constant power to the lamp 10. That is, the rectified voltage compensation circuit 28 compensates for the change of power supplied to the lamp 10 due to an unstable rectified voltage caused by an environmental factor.

For reference, power may be expressed as the product of current and voltage. Thus, the change of the power supplied to the lamp 10 may be compensated by controlling the current path for adjusting the current amount of the lamp 10. Thus, the power supplied for light emission of the lamp 10 may maintain a constant level. As a result, the luminance of the lamp 10 may be constantly maintained.

The rectified voltage compensation operation according to the embodiment of the present invention will be described with reference to the operations of the voltage sensing unit 40 and the compensation circuit 42.

Figure 3C:
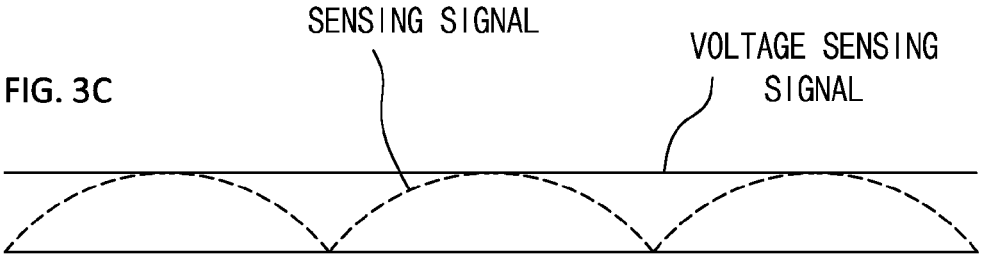

First, the voltage sensing unit 40 outputs a voltage sensing signal obtained by sensing the peak of the sensing signal outputted from the rectified voltage sensing unit 16 as illustrated in FIG. 3C, and the voltage sensing signal reflects variations of the rectified voltage in response to a power supply environment factor in a building, region, or country or a temporarily unstable power supply environment factor.

Figure 4:
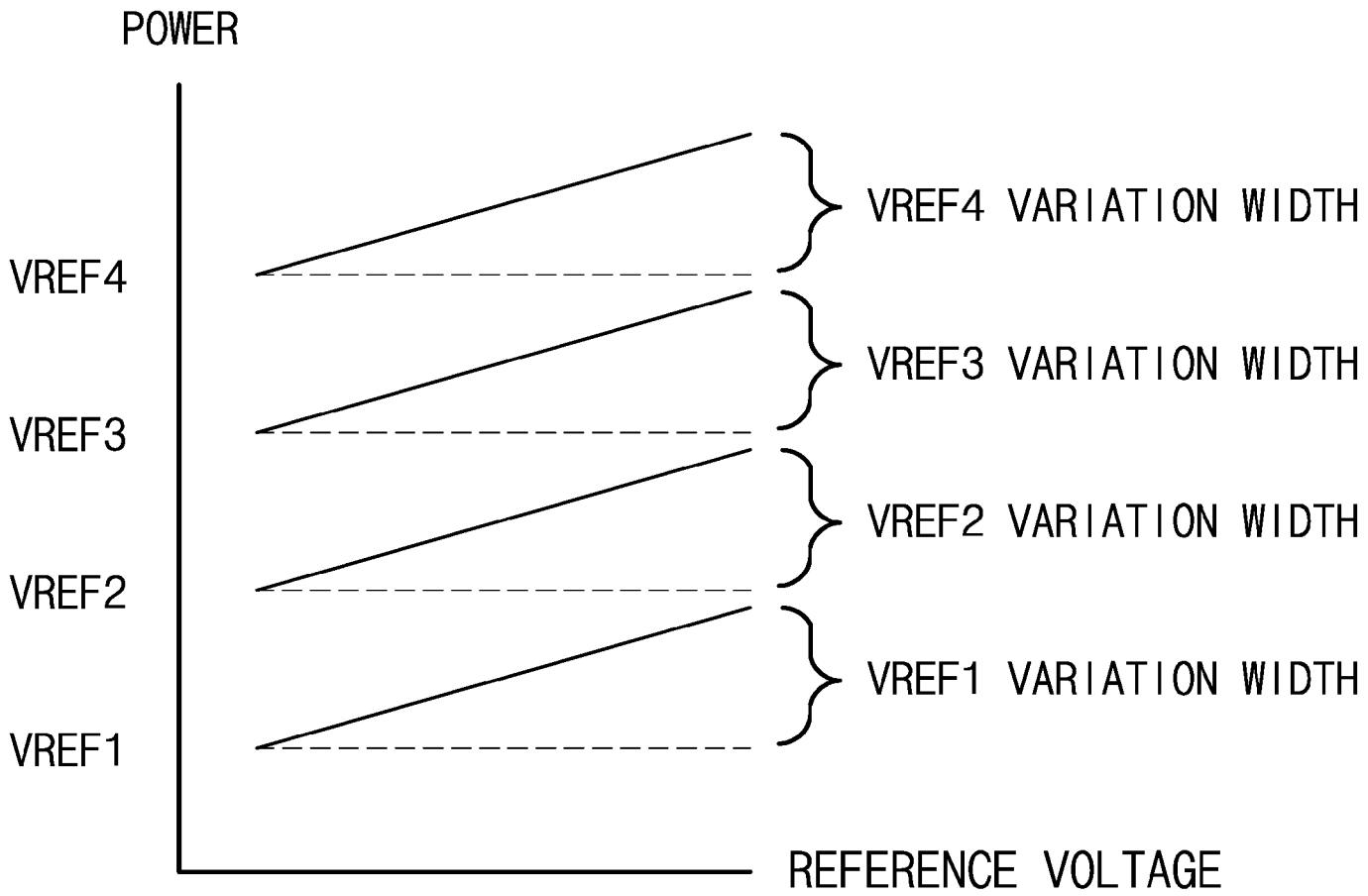
FIG. 4 is a graph illustrating changes of reference voltages.

The voltage sensing unit 40 provides the above-described voltage sensing signal to the compensation circuit 42, and the compensation circuit 42 provides a compensation signal corresponding to the voltage sensing signal to the reference voltage control unit 20. The reference voltage control unit 20 changes the reference voltages VREF1 to VREF4 for the respective LED groups in response to the compensation signal, as illustrated in FIG. 4.

The compensation signal may be set to a level which is inversely proportional to a variation of the rectified voltage. Furthermore, the compensation signal may retain the reference level, and the level of the compensation signal may be lowered or raised in response to the rise or fall of the rectified voltage.

More specifically, the compensation circuit 42 of FIG. 1 applies the compensation signal to the node which outputs the highest reference voltage among nodes between the respective resistances of the reference voltage control unit 20. That is, the compensation signal may be outputted as a DC voltage, and applied to the node which outputs the reference voltage VREF4, between the resistors R5 and R4 of the reference voltage control unit 20.

When the compensation signal is applied to the node which outputs the highest reference voltage among the nodes between the respective resistors of the reference voltage control unit 20, the compensation signal may be constantly reflected into the reference voltages VREF1 to VREF4 according to the resistance ratio of the respective resistors R4, R3, R2, and R1.

For example, when the rectified voltage is lowered, the compensation circuit 42 provides a compensation signal having a level which is inversely proportional to the lowered rectified voltage, to the reference voltage control unit 20.

The reference voltage control unit 20 provides the reference voltages VREF1 to VREF4, raised by the compensation signal, to the positive terminals (+) of the respective comparators 50 of the switching circuits 31 to 34.

As the voltage level of the positive terminal (+) is raised, the comparator 50 may provide the raised voltage to the gate of the NMOS transistor 52. The current driving ability of the NMOS transistor 52 is improved, and the amount of current flowing through the current path formed by the NMOS transistors 52 of the switching circuits 31 to 34 is increased in response to the light emissions of the respective LED groups LED1 to LED4 of the lamp 10.

The increase in amount of current flowing through the NMOS transistor 52 indicates the increase in amount of current supplied to the lamp 10. Thus, the power provided to the lamp may be constantly maintained in response to the compensation signal, and the luminance of the lamp 10 may also be constantly maintained.

On the other hand, even when the rectified voltage is raised, the compensation circuit 42 provides a compensation signal having a level which is inversely proportional to the raised rectified voltage, to the reference voltage control unit 20.

The reference voltage control unit 20 provides the lowered reference voltages VREF1 to VREF4 to the positive terminals (+) of the respective comparators 50 of the switching circuits 31 to 34.

As the voltage level of the positive terminal (+) is lowered, the comparator 50 may provide the lowered voltage to the gate of the NMOS transistor 52. As a result, the current driving ability of the NMOS transistor 52 is degraded, and the amount of current flowing through the current path formed by the NMOS transistors 52 of the switching circuits 31 to 34 decreases in response to the light emissions of the respective LED groups LED1 to LED4 of the lamp 10.

The decrease in amount of current flowing through the NMOS transistor 52 indicates the decrease in amount of current supplied to the lamp 10. Thus, the power provided to the lamp may be constantly maintained in response to the compensation signal, and the luminance of the lamp 10 may also be constantly maintained.

Figure 5:
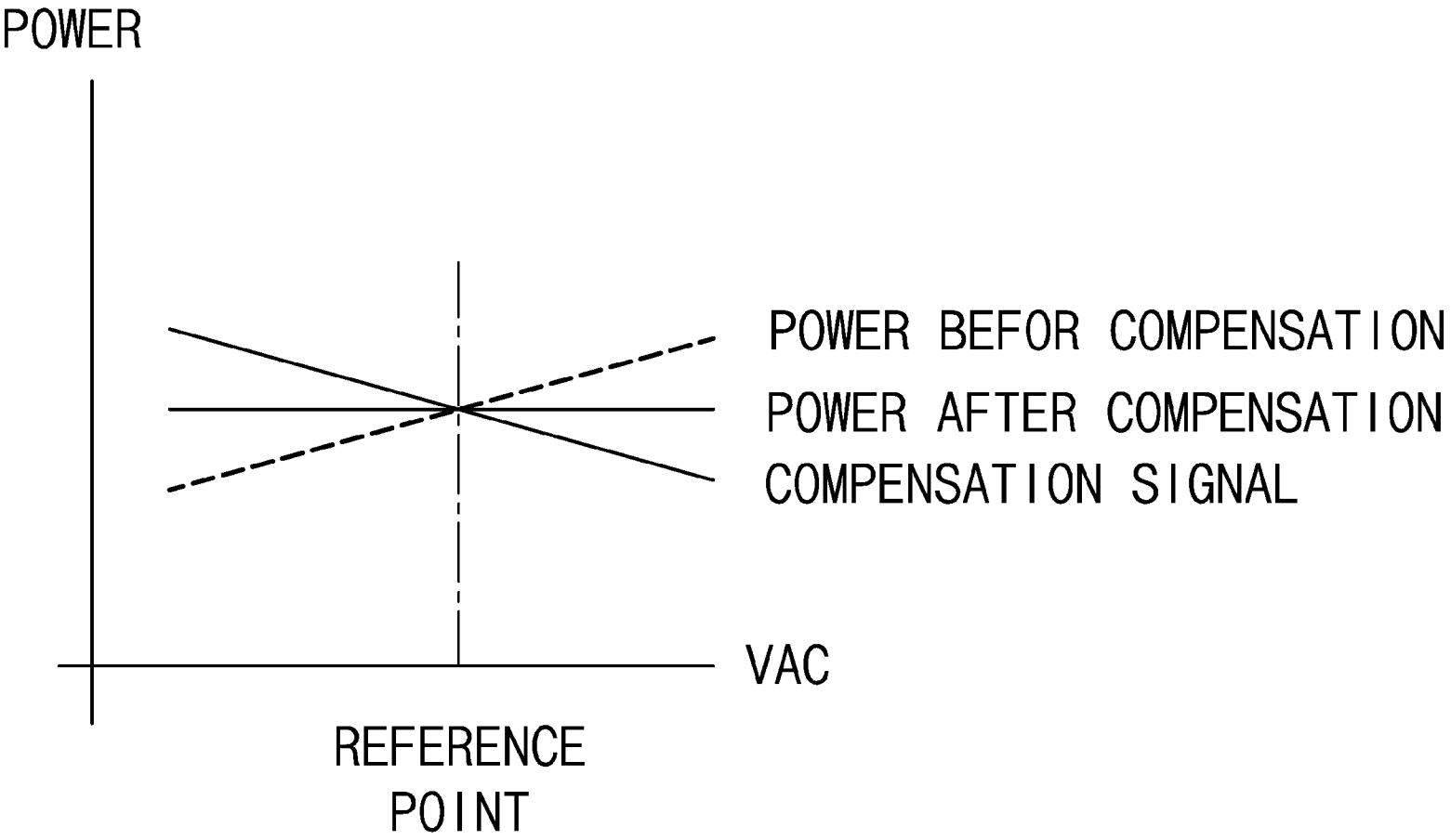
FIG. 5 is a graph illustrating that power is changed through compensation according to the embodiment of the present invention.

That is, although the power provided to the lamp 10 is varied around the reference point due to an environmental factor as illustrated in FIG. 5, the power may be constantly maintained by the above-described compensation signal, and the luminance of the lamp 10 may also be constantly maintained.

The embodiment of the present invention may be applied to the case in which the power provided to the lamp 10 is linearly changed according to the changes of the AC voltage VAC.

However, the power provided to the lamp 10 may be changed while having a curve characteristic, for example, a quadratic functional characteristic according to the change of the AC voltage VAC.

Figure 6:
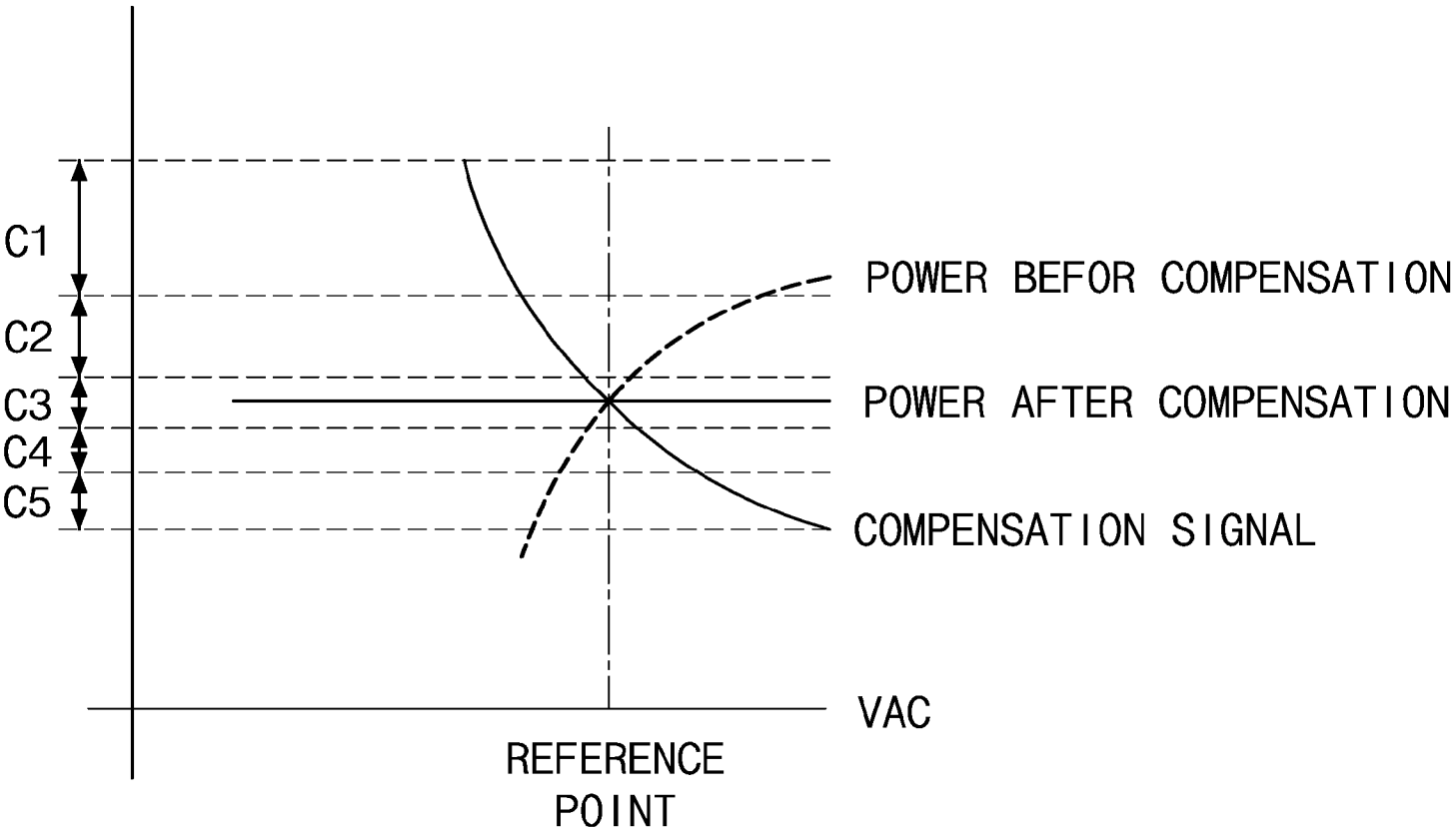
FIG. 6 is a block diagram illustrating a compensation circuit according to another embodiment of the present invention.

FIG. 6 is a graph illustrating that the power supplied to the lamp 10 is changed in response to the change of the AC voltage VAC due to the power supply environment, while having the above-described curve characteristic.

In the present embodiment, the change range of power (or rectified voltage change range) may be divided into five power change sections C1 to C5 in order to compensate for the power which is provided to the lamp 10 and changed to have a curve characteristic in response to the change of the AC voltage VAC, and a loop gain for compensating for the change of the power is differently applied to each of the divided sections. FIG. 6 illustrates that the power change range is divided into five sections C1 to C5, but the number of power change sections may be set to various values according to a designer's intention.

Figure 7:
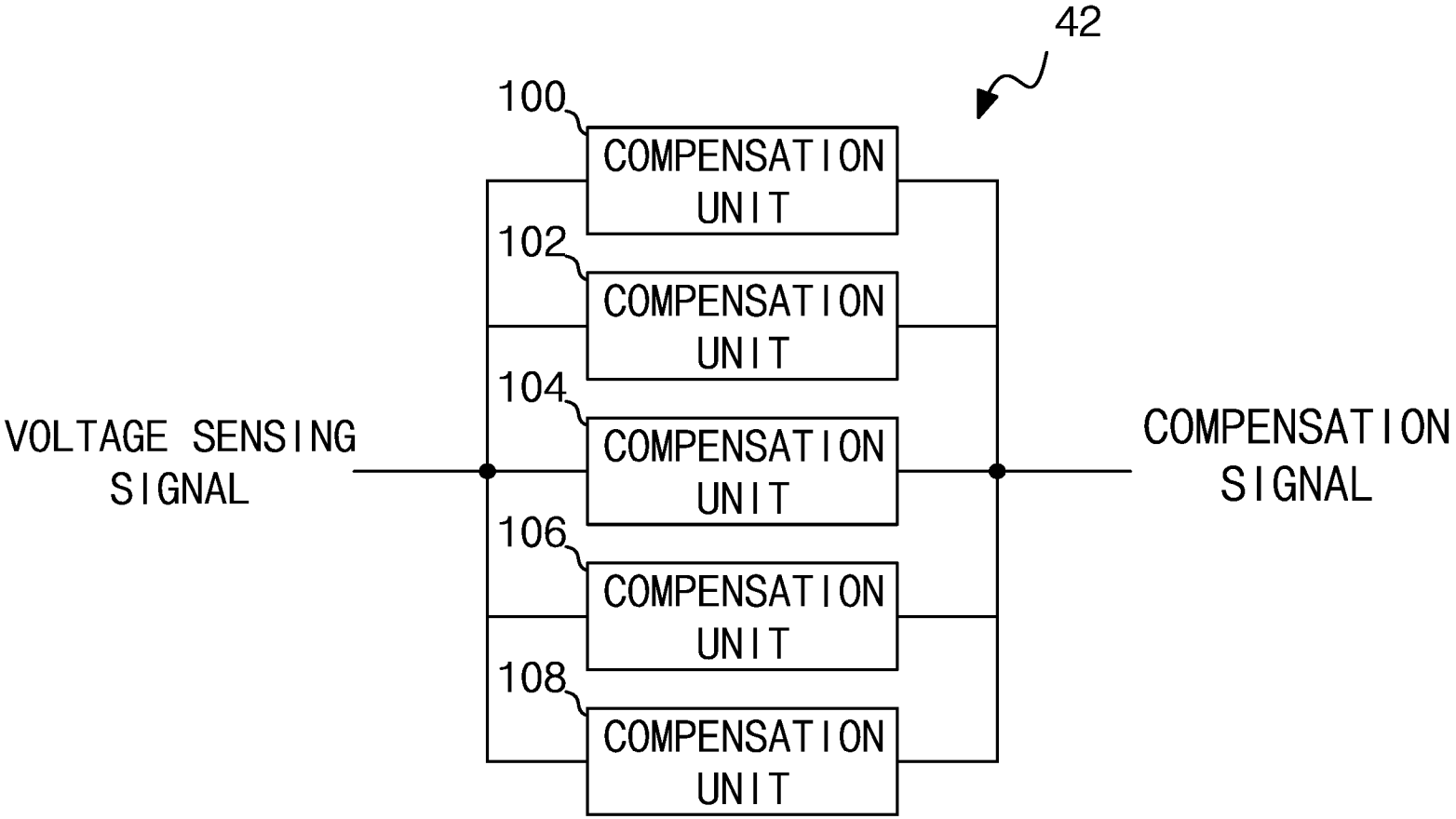
FIG. 7 is a graph illustrating that power is changed through compensation according to the embodiment of FIG. 6.

In the present embodiment, the compensation circuit 42 may be configured to have five compensation units 100, 102, 104, 106, and 108 according to the five power change sections, as illustrated in FIG. 7. That is, the compensation units 100, 102, 104, 106, and 108 of the compensation circuit 42, to which the voltage compensation signal outputted from the voltage sensing unit 40 is commonly applied, may be configured in parallel to each other, and the compensation signals outputted from the compensation units 100, 102, 104, 106, and 108 may be provided to the reference voltage control unit 20.

The compensation unit 100 has a loop gain for compensating for the power change corresponding to the section C1, the compensation unit 102 has a loop gain for compensating for the power change corresponding to the section C2, the compensation unit 104 has a loop gain for compensating for the power change corresponding to the section C3, the compensation unit 106 has a loop gain for compensating for the power change corresponding to the section C4, and the compensation unit 108 has a loop gain for compensating for the power change corresponding to the section C5.

Among the above-described compensation units 100, 102, 104, 106, and 108, the largest loop gain may be set to the compensation unit corresponding to the highest power, and the smallest loop gain may be set to the compensation unit corresponding to the lowest power. That is, the loop gains may be set according to a relation of the compensation unit 100>the compensation unit 102>the compensation unit 104>the compensation unit 106>the compensation unit 108.

Furthermore, the loop gains of the compensation units 100, 102, 104, 106, and 108 may be set to reflect the power changes of the corresponding sections C1 to C5. As illustrated in FIG. 6, the power provided to the lamp 10 may be changed while having a curve characteristic in response to the change of the AC voltage VAC. Furthermore, the power provided to the lamp 10 may be changed while having a curve characteristic within the sections C1 to C5. Thus, the compensation units 100, 102, 104, 106, and 108 may be set to have representative values which are capable of representing the changes of the corresponding sections C1 to C5. For example, a value obtained by differentiating the change of a section may be set to a loop gain, or a value obtained by correcting the value obtained by differentiating the change of the section, for deviation adjustment, may be set to a loop gain.

As described above, the compensation circuit 42 includes the compensation units 100, 102, 104, 106, and 108 having different loop gains, and each of the compensation units 100, 102, 104, 106, and 108 outputs a compensation signal to which the loop gain thereof is applied, when the voltage sensing signal outputted from the voltage sensing unit 40 corresponds to the compensation unit. That is, the compensation circuit 42 may output a compensation signal to which a different loop gain is applied at each of the sections C1 to C5, in response to the level of the power provided to the lamp 10 according to the change of the AC voltage VAC.

That is, the compensation circuit 42 may output the compensation signal to which a different loop gain is applied at each of the sections C1 to C5, to the node which outputs the highest reference voltage among the nodes between the respective resistors of the reference voltage control unit 20, in response to the level of the power provided to the lamp 10 according to the change of the AC voltage VAC. Thus, the reference voltage control unit 20 provides the reference voltages VREF1 to VREF4 into which the compensation signal is reflected.

As described above, the reference voltages VREF1 to VREF4 reflecting the change of the power provided to the lamp 10 may be provided to the positive terminals (+) of the respective comparators 50 of the switching circuits 31 to 34.

As a result, the current driving ability of the NMOS transistor 52 may be differently adjusted according to the change of the power provided to the lamp 10. Thus, the amount of current supplied to the lamp 10 may be adjusted.

Therefore, the control circuit according to the embodiment of FIGS. 6 and 7 can control the reference voltages using the compensation signal to which a different loop gain is applied at each of the sections C1 to C5, in response to the level of the power provided to the lamp 10 according to the change of the VC voltage VAC. Thus, the amount of current supplied to the lamp 10 can be adjusted to constantly maintain the power provided to the lamp 10, and the luminance of the lamp 10 can be constantly maintained.

While various embodiments have been described above, it will be understood to those skilled in the art that the embodiments described are by way of example only. Accordingly, the disclosure described herein should not be limited based on the described embodiments.

The invention claimed is:

1. A control circuit of an LED lighting apparatus which includes a plurality of LED groups to emit light according to a rectified voltage, the control circuit comprising:

a rectified voltage sensing unit configured to sense the rectified voltage and provide a sensing signal; and a control unit configured to compare reference voltages to a current sensing voltage corresponding to a current amount based on light emission of the LED groups, the reference voltages being allocated to the respective LED groups and having a level controlled in response to the sensing signal, and provide a current path corresponding to the light emitting states of the LED groups, wherein the level of the reference voltages is controlled to be inversely proportional to variation of the rectified voltage in order to secure uniform luminance by compensating for a non-uniformity of power, and the current amount on the current path is controlled in response to the sensing signal.

2. The control circuit of claim 1, wherein the rectified voltage sensing unit outputs a signal obtained by scaling down the rectified voltage as the sensing signal.

3. The control circuit of claim 1, wherein the control unit comprises:

a rectified voltage compensation circuit configured to generate a compensation signal corresponding to change of the power provided to the plurality of LED groups, in response to the sensing signal;

a reference voltage control unit configured to provide the reference voltages into which the compensation signal is reflected; and a plurality of switching circuits provided for the respective LED groups, and configured to compare the reference voltages allocated to the respective LED groups to the current sensing voltage corresponding to the current amount of the current path and provide the current path corresponding to the light emitting states of the LED groups.

4. The control circuit of claim 3, wherein the rectified voltage compensation circuit generates the compensation signal at a level which is inversely proportional to variation of the rectified voltage.

5. The control circuit of claim 3, wherein the change range of the power is divided into a plurality of sections, and the rectified voltage compensation circuit generates the compensation signal by applying a different loop gain at each of the sections.

6. The control circuit of claim 3, wherein the rectified voltage compensation circuit comprises:

a voltage sensing unit configured to sense the peak of the rectified voltage using the sensing signal, and provide a voltage sensing signal corresponding to the peak; and a compensation circuit configured to generate the compensation signal corresponding to the change of the power provided to the plurality of LED groups, in response to the level of the voltage sensing signal.

7. The control circuit of claim 3, wherein the rectified voltage compensation circuit comprises:

a voltage sensing unit configured to sense the peak of the rectified voltage using the sensing signal and provide a voltage sensing signal corresponding to the peak; and a compensation circuit configured to divide the change of the power into a plurality of sections, and generate the compensation signal corresponding to the change of the power provided to the plurality of LED groups by applying a different loop gain at each of the sections.

8. The control circuit of claim 7, wherein the compensation circuit comprises a plurality of compensation units each having the loop gain corresponding to the section, and configured to output the compensation signal corresponding to the loop gain.

9. The control circuit of claim 1, wherein the control unit decreases the current amount on the current path when the rectified voltage is raised, and increases the current amount on the current path when the rectified voltage is lowered.

10. The control circuit of claim 9, wherein the control unit divides the power change of the power into a plurality of periods, and controls the current amount by applying a different loop gain at each of the sections.

11. A control circuit of an LED lighting apparatus which comprises a plurality of LED groups to emit light according to a rectified voltage, the control circuit comprising:

a rectified voltage sensing unit configured to provide a sensing signal obtained by sensing the rectified voltage;

a rectified voltage compensation circuit configured to generate a compensation signal corresponding to change of the power provided to the plurality of LED groups in response to the sensing signal;

a reference voltage control unit configured to reflect the compensation signal and provide reference voltages allocated to the respective LED groups; and a plurality of switching circuits provided for the respective LED groups, and configured to compare the reference voltages to a current sensing voltage corresponding to a current amount based on light emission of the LED groups, and provide a current path corresponding to the light emitting states of the LED groups, wherein a level of the reference voltages is controlled to be inversely proportional to variation of the rectified voltage in order to secure uniform luminance by compensating for a non-uniformity of the power provided to the plurality of LED groups, such that the current amount on the current path is controlled.

12. The control circuit of claim 11, wherein the rectified voltage compensation circuit comprises:

a voltage sensing unit configured to sense the peak of the rectified voltage using the sensing signal, and provide a voltage sensing signal corresponding to the peak; and a compensation circuit configured to generate the compensation signal corresponding to the change of the power provided to the plurality of LED groups, in response to the level of the voltage sensing signal.

13. The control circuit of claim 11, wherein the rectified voltage compensation circuit comprises:

a voltage sensing unit configured to sense the peak of the rectified voltage using the sensing signal and provide a voltage sensing signal corresponding to the peak; and a compensation circuit configured to divide the change range of the rectified voltage into a plurality of sections, and generate the compensation signal corresponding to the change of the power provided to the plurality of LED groups by applying a different loop gain at each of the sections.

14. The control circuit of claim 13, wherein the compensation circuit comprises a plurality of compensation units each having the loop gain corresponding to the section, and configured to output the compensation signal corresponding to the loop gain.

15. The control circuit of claim 13, wherein the rectified voltage compensation circuit generates the compensation signal to decrease the current amount on the current path when the rectified voltage is raised, and to increase the current amount on the current path when the rectified voltage is lowered.

16. The control circuit of claim 11, wherein the rectified voltage compensation circuit, the reference voltage control unit, and the plurality of switching circuits are included in a control unit implemented as one chip.

17. The control circuit of claim 11, wherein the reference voltage control unit and the plurality of switching circuits are included in a control unit implemented as one chip.

* * * * *